United States Patent [19]

Farinacci

[11] Patent Number: 4,823,699

[45] Date of Patent: Apr. 25, 1989

[54] BACK-ACTUATED FORWARD IGNITION AMMUNITION AND METHOD

[75] Inventor: Anthony L. Farinacci, Baldwin, Md.

[73] Assignee: AAI Corporation, Hunt Valley, Md.

[21] Appl. No.: 38,085

[22] Filed: Apr. 14, 1987

[51] Int. Cl.[4] ..... F42B 5/16

[52] U.S. Cl. ..... 102/443; 102/439; 102/521

[58] Field of Search ..... 102/443, 430, 520, 521, 102/441, 433, 434, 469, 470, 439

[56] References Cited

U.S. PATENT DOCUMENTS

| | | | |
|---|---|---|---|
| 117,388 | 7/1871 | Crary . | |
| 314,127 | 3/1885 | Hope et al. . | |
| 1,920,075 | 7/1933 | Haenichen . | |
| 3,648,616 | 3/1972 | Hsu . | |
| 4,197,801 | 4/1980 | LaFever et al. | 102/443 |
| 4,335,657 | 6/1982 | Bains | 102/443 |
| 4,542,696 | 9/1985 | Bisping et al. | 102/430 |
| 4,619,202 | 10/1986 | Romer et al. | 102/443 |
| 4,625,648 | 12/1986 | Klein et al. | 102/443 |
| 4,671,179 | 6/1987 | Synofzik et al. . | |
| 4,691,638 | 9/1987 | Meyer et al. | 102/434 |

*Primary Examiner*—Deborah L. Kyle
*Assistant Examiner*—Daniel Wasil
*Attorney, Agent, or Firm*—Reginald F. Pippin, Jr.

[57] ABSTRACT

A back-actuated forward ignition cartridge having a case, a puller sabot and rod penetrator projectile in the forward mouth end of the case, and a combination compacted propellant solid mass and loose propellant charge ignitable by back ignition through actuation of a rear primer and guided flame propagation through a guide tube extending through the compacted propellant mass and to the vicinity of the loose propellant charge, while preventing ignition of the compacted propellant mass as the flame passes along the tube therethrough. The guide tube has a booster ignition charge therein to assist in forward flame propagation and ignition of the loose propellant. Burning of the loose propellant charge effects pressurized constriction of the sabot about the projectile and drives the sabot/projectile from the case and along a barrel bore, thereby increasing the effective burning volume prior to ignition of the compacted propellant solid mass. The burning of the loose propellant also effects ignition of the compacted propellant solid mass, the burning of which impacts a large further thrust to the projectile of greater amount than would be effected by employment of a solely loose propellant charge of material comparable to the employed propellant or propellants.

15 Claims, 1 Drawing Sheet

BACK-ACTUATED FORWARD IGNITION AMMUNITION AND METHOD

The U.S. Government has a paid-up license in this invention and the right in limited circumstances to require the patent owner to license others on reasonable terms as provided for by the terms of Contract FO8635-83-C-0507 awarded by the Department of the Air Force.

This invention relates to cartridges and in particular to a back-actuated forward ignition cartridge and a method of back-actuated forward ignition of propellant for a cartridge deploying a discarding sabot projectile.

As technology has improved the quality of armor-plating, it has become necessary to develop artillery shells capable of neutralizing the advantages of armor-plated ordnance equipment which might be deployed by enemy forces. In order to penetrate such armor-plating with a discarding sabot projectile, it is necessary to maximize projectile velocity. One way to accomplish this is to increase propellant density. This can be achieved by using consolidated or compacted propellant wafers formed from loose propellant that has been subjected to a solvent and then compressed under pressure. Consolidated propellant wafers present a problem in that, if the propellant is ignited too rapidly, an uncontrolled combustion may occur, with possible resulting explosion of the cartridge case and weapon in which it is being fired. The design of prior cartridges using compacted or consolidated propellant solid masses such as propellant wafers has heretofore inadequately resolved the difficulties involved with utilizing such compacted or consolidated propellant solid masses to maximize projectile velocity.

It is an object and feature of the invention to provide a cartridge and method of enabling use of a compacted or consolidated propellant solid mass while reducing the likelihood of explosion therefrom.

It is a further object and feature of the invention to provide an improved method and cartridge in which a rear solid propellant mass is ignited by primer-actuated ignition of a loose propellant charge forward of the rear solid propellant mass, and in which the ignition of the loose propellant charge effects ejection of the cartridge projectile into the barrel prior to effective ignition of the rear solid propellant mass.

It is a further object and feature of the invention to provide a cartridge and method in which a solid propellant mass is ignited shortly after first ejecting the cartridge projectile and prior to the projectile's leaving the weapon barrel, so as to reduce the likelihood of excess pressures from high-rate burning of the concentrated volume solid propellant mass.

Still other objects, features and attendant advantages will become apparent from a reading of the following summary and detailed descriptions of a preferred embodiment of the invention, taken in conjunction with the accompanying drawings, wherein.

Figures 1, 2, 3:
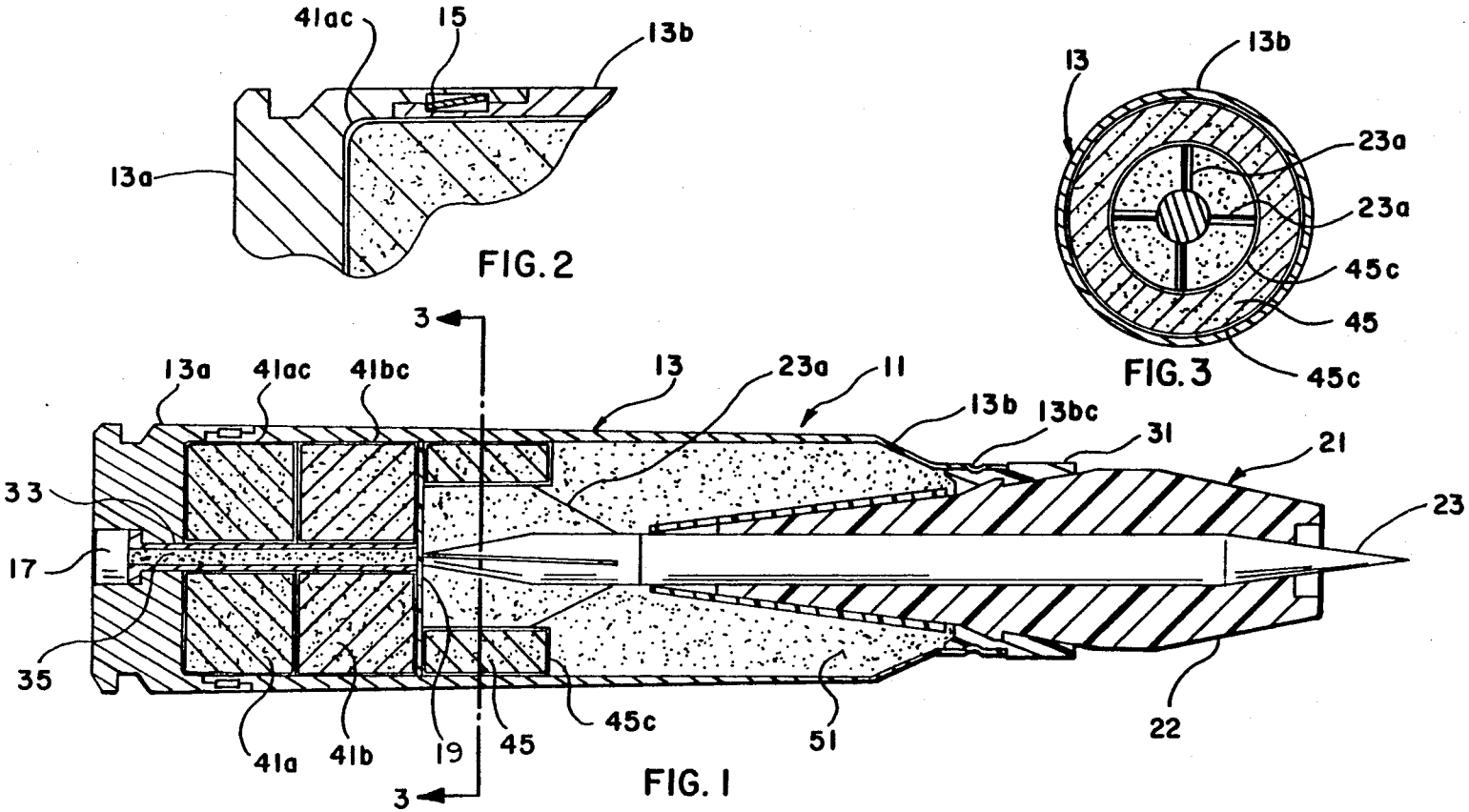
FIG. 1 is a view, in partial longitudinal section, of a cartridge constructed according to the invention.
FIG. 2 is an enlarged view of a section of the case of the embodiment of FIG. 1.
FIG. 3 is a section view taken on line 3—3 of FIG. 1.

In general summary, the back-actuated front ignition system of this invention enables the use of compacted or consolidated propellant solid-mass wafers by combustion of such compacted or consolidated propellant mass wafers until after initial ignition of a loose propellant adjacent the projectile and which causes ejection of the projectile before effective ignition of the solid mass wafers occurs. The loose propellant is positioned and segregated in the front part of the cartridge case while the propellant wafers are located in the base of the cartridge near the base of the cartridge case, and a flame-guiding and -insulating booster tube extends through the rear propellant wafers and connects between the primer and the vicinity of the forward loose propellant compartment to effect ignition flame propagation to the loose propellant upon actuation of the primer. Desirably, a booster charge is contained within the tube to assure effective flame continuation propagation to the loose propellant for primer-actuated ignition thereof. All of the wafers are preferably bonded to the case wall with an epoxy resin, which is also used between the inner surface of the rear wafers and flame-guiding and -insulating booster tube.

Segregation of the two types of propellants permits them to be ignited in stages. The loose propellant, ignited first, furnishes sufficient combustion to initiate separation of the projectile assembly from the case front section. This separation of the projectile assembly from the case furnishes additional volume to accommodate the combustion of the propellant wafers which occurs as the second stage of the ignition. Thus, the arrangement provides for operationally effective additional volume which reduces the risk of explosion presented by using the propellant wafers while affording the increased velocity advantages attained through use of compacted or consolidated propellant solid-mass wafers.

Referring now in detail to the Figures of the drawings, a cartridge 11 is provided, having a two-piece case 13 which includes a case base 13*a* and a case front section 13*b* secured together by a conventional split annular ring 15.

A sabot/rod penetrator assembly 21 is suitably crimp-secured in the open forward end of the case front section 13*b*, as by crimping of the case about a bore-riding and -sealing ring 31 as indicated at 13*bc*.

Sabot/rod penetrator assembly 21 includes a conventional longitudinally split pressure-responsively gripping puller sabot 22 and a fin-stabilized rod penetrator projectile 23 having rear fins 23*a*.

A plurality of compacted or consolidated propellant solid masses, which are termed as wafers 41*a* and 41*b*, are disposed within and adjacent the base end of the case 13. These wafers 41*a* and 41*b* are each coated with a combustion-erodable ignition-inhibiting material, such as epoxy-resin, as indicated at 41*ac* and 41*bc*. The wafers may be suitably formed of conventional nitrocellulose-base stick propellant which has been moistened with a suitable conventional solvent such as acetone and ethyl alcohol and compressed at a suitable pressure, e.g., 400 psi, into compacted cakes of the desired configuration, as shown, to fit within the case 13. After compacting, the solvent is dried off and the cakes are coated with epoxy as by painting and curing of the epoxy.

Extending through the center of wafers 41*a* and 41*b* is a metal tube 33 which serves to guide ignition flame propagation from a primer 17 in the base of case 13 along a path through the wafers 41*a* and 41*b* and to the forward end section of the case 13 which contains a charge of loose propellant powder, which may suitably be conventional fluid ball double-base propellant.

All of the wafers are preferably bonded to the wall of case 13 with an epoxy resin, which is also used as a bond between the radially inner surface of the rear wafers 41*a*, 41*b* and the flame-guiding and -insulating tube 33.

A separator disk 19 formed of a combustion-erodable ignition-inhibiting material such as plastic, e.g. cellulose acetate, is disposed forwardly of and lies against the forward fin wafer 45. Disk 19 serves to contain the loose powder from undesired entry into the zone of the wafers 41*a* and 41*b* prior to ignition, as well as serving to inhibit ignition of the rear wafers 41*a* and 41*b* until after ignition of the loose propellant charge effects ejection of the projectile from the case and into the gun barrel (not shown).

A booster charge 35 is preferably contained in the tube 33 to assist in flame propagation from the primer 17 to the loose propellant charge 51.

Disposed about the projectile fin area is a further compacted or consolidated propellant mass wafer 45, termed a fin wafer, which is formed in the shape of a torus which encompasses the fins 23*a*. Fin wafer 45 is coated with epoxy as indicated at 45*c*, similarly to wafers 41*a* and 41*b*. The loose propellant charge 51 preferably fills the entire case volume bonded by the separator disk 19, the bore-riding and -sealing ring 31, the sabot 21 and projectile 23, and the fin wafer 45.

When the primer means 17 is initiated, the ignition flame propagates into the booster tube 33 which insulates the wafers 41*a* and 41*b* from the ignition flame. The ignition flame ignites the booster charge 35 which augments the propagation of the ignition flame forward. The ignition of the booster charge 35 ruptures the separator disk 19 allowing the ignition of the loose propellant 51. As the loose propellant 51 burns, pressure is increased on the outer surface of the sabot 22 until the rod penetrator assembly 21 is forced loose and ejected forwardly from the cartridge case 13 and into the weapon barrel bore (not shown). As the combustion of the loose propellant 51 increases, fin wafer 45 is ignited, which then burns through separator disk 19 into rear wafers 41*a* and 41*b*, which are thereupon ignited last.

The back-actuated forward ignition arrangement enables the ignition of the rear wafers 41*a* and 41*b* to be delayed until there is an increased volume available for combustion, as a result of sabot/projectile assembly 23 being ejected from the case front section 13*b* and into the weapon barrel. This arrangement reduces the possibility of explosion presented by high-rate burning of completed propellant wafers 41*a*, 41*b* and 45 while enabling the attainment of the advantages of increased projectile velocity from use of compacted solid mass propellant in the form of wafers 41*a*, 41*b* and 45.

While the invention has been illustrated and described with respect to a single preferred embodiment, the invention is not to be limited to this embodiment, but only by the scope of the appended claims.

I claim:

1. A back-actuated forward ignition cartridge comprising a cartridge case having an open forward end, a fin-stabilized projectile having stabilizing fins on its rear end, a puller sabot secured in said forward end of said case and carrying said projectile, said puller sabot having a tapered rear end, and said stabilizing fins being disposed rearwardly of said sabot, a compacted propellant formed as a solid mass disposed in the rear section of said case, rearward of said projectile, loose propellant disposed about said tapered rear end of said puller sabot and said projectile fins and disposed forward of said compacted propellant solid mass, primer means disposed in the rear end of said case, and flame-guiding means connecting between said primer means and the forward section of said case and extending through said compacted propellant mass to enable ignition flame propagation from said primer means to the vicinity of said loose propellant to thereby enable primer-initiated ignition of said loose propellant prior to ignition of said compacted propellant.

2. A cartridge according to claim 1, further comprising a separator disk disintegrable under burning of propellant and disposed between said loose propellant and said compacted solid propellant mass.

3. A cartridge according to claim 2, said flame-guiding means comprising a flame-guiding and -insulating tube extending between said primer means and the vicinity of said loose propellant.

4. A cartridge according to claim 3, and a further compacted propellant solid mass disposed forward of said separator disk and surrounding the rear portion of said projectile and being disposed adjacent said loose propellant.

5. A cartridge according to claim 4, said further compacted propellant solid mass being formed as a torus disposed about said stabilizing fins.

6. A cartridge according to claim 5, said loose propellant being dispersed within said torus and about said sabot and said stabilizing fins of said projectile.

7. A cartridge according to claim 6, wherein said loose propellant substantially fills the volume within said case surrounding said sabot, the projectile rear-finned zone of said projectile, and within said further compacted propellant solid-mass torus.

8. A cartridge according to claim 1, said flame-guiding means comprising a flame-guiding and -insulating tube extending between said primer means and the vicinity of said loose propellant.

9. A cartridge according to claim 1, said compacted propellant mass having a flame-erodable ignition inhibitor on its outer surface.

10. A cartridge according to claim 9, said flame-guiding means comprising a flame-guiding and -insulating tube extending between said primer means and the vicinity of said loose propellant.

11. The method of firing a cartridge having a rear compacted solid-mass propellant charge, a rear primer, and a projectile in a case, said method comprising:

actuating said primer to form an ignition flame, protectively passing a continuation of said ignition flame past said compacted solid-mass propellant to the vicinity of a loose propellant charge adjacent said projectile, to thereby ignite said loose propellant charge without ignition of said solid-mass propellant charge during passage of said ignition flame therepast, and igniting said solid propellant mass through the burning of said loose propellant and after the ejection of said projectile from said case, said projectile being a fin-stabilized projectile having rear stabilizing fins and being carried by a pressure-responsive puller sabot initially secured in said case, and said loose propellant being disposed adjacent and about the rear of said sabot and said fins, said method further comprising effecting pressure-responsive gripping of said projectile as a function of pressure build-up from burning of said loose propellant charge prior to ejection of said projectile from said case, to thereby enable simultaneous ejection of said sabot and projectile from said case as a function of burning of said loose propellant charge.

12. The method according to claim 11, said protective passage of said flame continuation past said compacted solid-mass propellant charge being effected by passing said flame continuation through a flame-guiding tube connecting between said primer and the vicinity of said loose propellant charge.

13. The method according to claim 12, said flame-guiding tube having a flame-enhancing booster charge therein, and enhancing said flame continuation by ignition of said ignition booster charge as a function of actuation of said primer.

14. The method according to claim 13, in which said projectile has stabilizing fins at its rear end, said loose propellant extends about said sabot and said fins, and a fin-encompassing portion of said compacted solid-mass propellant is formed as a torus disposed about the fin area of said projectile, said method further comprising igniting a said portion of said compacted solid-mass propellant disposed about said fins through burning of said propellant.

15. The method according to claim 14, said compacted solid-mass propellant including a further rear compacted solid-mass propellant rearward of said fin-encompassing compacted solid-mass propellant portion, said method further comprising separating said rear compacted solid-mass propellant portion from said fin-encompassing compacted solid-mass propellant torus by a flammable burn-inhibiting separator disk to effect both initial physical separation of the loose propellant charge from the rear compacted solid-mass propellant and a degree of ignition inhibition of said rear compacted solid-mass propellant.

* * * * *